US007721583B1

(12) United States Patent
Anderson et al.

(10) Patent No.: US 7,721,583 B1
(45) Date of Patent: May 25, 2010

(54) PIPE BENDING SHOE

(75) Inventors: Clifford B. Anderson, Edmonton (CA); David Styre, Edmonton (CA); Brian Thicke, Edmonton (CA)

(73) Assignee: Proline Pipe Equipment Inc., Edmonton, Alberta (CA)

( * ) Notice: Subject to any disclaimer, the term of this patent is extended or adjusted under 35 U.S.C. 154(b) by 0 days.

(21) Appl. No.: 12/436,997

(22) Filed: May 7, 2009

(51) Int. Cl.
*B21D 3/10* (2006.01)
*B21D 9/08* (2006.01)

(52) U.S. Cl. ..... 72/382; 72/389.1; 72/389.8; 72/390.4; 72/466.8; 72/383

(58) Field of Classification Search ..... 72/381, 72/383, 389.6, 389.8, 466, 466.8, 390
See application file for complete search history.

(56) References Cited

U.S. PATENT DOCUMENTS

| | | | | |
|---|---|---|---|---|
| 2,938,564 | A | 5/1960 | Rhodes | |
| 3,834,210 | A | 9/1974 | Clavin et al | |
| 3,934,450 | A | 1/1976 | Reed | |
| 4,313,330 | A * | 2/1982 | Cummings | 72/307 |
| 4,331,108 | A | 5/1982 | Doyle | |
| 5,092,150 | A | 3/1992 | Cunningham | |
| 5,123,272 | A | 6/1992 | Heaman | |
| 5,237,847 | A | 8/1993 | Owens | |
| 5,469,730 | A | 11/1995 | Heaman | |
| 5,600,993 | A | 2/1997 | Heaman | |
| 5,884,519 | A | 3/1999 | Theener | |
| 6,298,706 | B1 | 10/2001 | Dunn | |
| 6,550,303 | B2 | 4/2003 | Rogers | |
| 7,047,789 | B1 | 5/2006 | Theener | |

FOREIGN PATENT DOCUMENTS

| | | |
|---|---|---|
| CA | 2050839 | 4/1995 |
| CA | 2189099 | 3/2000 |
| CA | 2158539 | 5/2000 |
| CA | 2516410 | 1/2007 |

* cited by examiner

*Primary Examiner*—David B Jones
(74) *Attorney, Agent, or Firm*—Terrence N. Kuharchuk; Rodman & Rodman

(57) ABSTRACT

A pipe bending shoe including a support frame, a pipe channel defined by a first bending frame connected with the support frame and by a second bending frame connected with the support frame, and a plurality of flexible straps spaced along the pipe channel and spanning the pipe channel transversely between the first bending frame and the second bending frame in order to provide a transversely segmented pipe sling, wherein the pipe sling maintains a constant convex longitudinal sling profile during bending of a pipe using the pipe bending shoe.

19 Claims, 2 Drawing Sheets

PIPE BENDING SHOE

TECHNICAL FIELD

A pipe bending shoe for use in bending a tubular structure such as a pipe.

BACKGROUND OF THE INVENTION

Tubular structures such as pipe are typically manufactured in straight lengths. Individual lengths or joints of pipe may be connected together to form a conduit or a pipeline.

It is frequently necessary to bend pipe in order to provide a bend in a pipeline. Pipe may be bent in a shop using a stationary bending apparatus, or may be bent in a yard or in the field using a mobile bending apparatus.

In either case, the pipe is typically bent by applying one or more forces to the pipe in order to bend the pipe around a pipe bending shoe which is positioned adjacent the pipe.

As one non-limiting example of a pipe bending procedure, a pipe may be supported by supports located at both ends of the pipe, a pipe bending shoe may be located between the ends of the pipe, and forces may be applied to one or more of the supports and/or the pipe bending shoe in order to cause the pipe to bend around the pipe bending shoe.

As a second non-limiting example of a pipe bending procedure, a pipe may be supported by a cantilever support located at a first end of the pipe, a pipe bending shoe may be located between the cantilever support and a second end of the pipe, and a force may be applied to the second end of the pipe in order to cause the pipe to bend around the pipe bending shoe.

As a third non-limiting example of a pipe bending procedure, a first end of a pipe may be supported by a ground surface, a pipe bending shoe may be located between the first end and a second end of the pipe, and an upward force may be applied to the second end of the pipe in order to cause the pipe to bend around the pipe bending shoe. This third exemplary pipe bending procedure is often performed in the field using a tractor having a pipe bending shoe mounted thereon, wherein the upward force is provided by a winch on the tractor.

A challenge in bending pipe is to avoid collapse of the pipe wall as a portion of the circumference of the pipe is placed in compression and a portion of the circumference of the pipe is placed in tension during the pipe bending procedure. The tendency of a pipe wall to flatten during bending increases as the diameter of the pipe increases. In addition, pipe which is coated with a layer of a protective or insulating material is particularly susceptible to damage to the coating during a pipe bending procedure, either due to the force which is applied directly to the coating by the pipe bending shoe or due to the deformation of the underlying pipe during the pipe bending procedure.

A number of different styles of pipe bending shoe are known.

A first exemplary style of pipe bending shoe includes a rigid die which defines a pipe channel having a convex longitudinal profile. At the initiation of a pipe bending procedure, a relatively small area of the pipe channel is in contact with the pipe. As the pipe bending procedure continues and the amount of force which is applied to the pipe increases, the amount of area of the pipe channel which is in contact with the pipe progressively increases as the pipe is bent to conform with the convex longitudinal profile of the pipe channel. An advantage of this first style of pipe bending shoe is that the contact area between the pipe bending shoe and the pipe increases as increasing force is applied to the pipe in order to bend the pipe around the pipe bending shoe. A disadvantage of this first style of pipe bending shoe is that the rigidity of the pipe channel may increase the risk of damage to a coating which has been applied to the pipe. An example of this first style of pipe bending shoe are the Proline™ Pipe Bending Die Sets which are manufactured by Proline Pipe Equipment Inc. of Edmonton, Alberta, Canada.

A second exemplary style of pipe bending shoe includes a frame upon which are mounted a plurality of discrete spring-loaded segments which are arranged end to end to define a pipe channel. At rest, the spring-loaded segments have a straight longitudinal profile. As a pipe is bent around the pipe bending shoe, the spring-loaded segments deflect to conform with the developing bend in the pipe. An advantage of this second style of pipe bending shoe is that each of the spring-loaded segments may be in contact with the pipe during the entire pipe bending procedure. A disadvantage of this second style of pipe bending shoe is that the force which is applied to the pipe by the pipe bending shoe during the pipe bending procedure may not be evenly distributed amongst the spring-loaded segments, which may increase the risk of collapse of the pipe wall and/or damage to a coating which has been applied to the pipe. An example of this second style of pipe bending shoe is the Proline™ Tractor Bending Shoe which is manufactured by Praline Pipe Equipment Inc. of Edmonton, Alberta, Canada.

A third exemplary style of pipe bending shoe is described in U.S. Pat. No. 5,123,272 (Heaman). This pipe bending shoe includes a pressure member having a material contacting surface divided into a plurality of discrete transverse segments which are movable during the bending process to accommodate a bend in the material, and includes means for distributing the load among the segments so that the load required for the proper bending moment is distributed among all of the segments. A disadvantage of this third style of pipe bending shoe is that the means for distributing the load among the segments may be relatively complex.

A fourth exemplary style of pipe bending shoe is described in U.S. Pat. No. 5,600,993 (Heaman). This pipe bending shoe includes a pair of straight resilient spring-like shafts, a single flexible web extending between the pair of shafts, and means for securing the flexible web to the resilient shafts. The pipe bending shoe may further include a plurality of flexible tubular rollers extending over the shafts. During a pipe bending procedure, the resilient shafts and the flexible rollers flex to accommodate the bending of the pipe so that the flexible web maintains contact with the pipe. The resilient shafts and the flexible rollers spring back to their original straight configuration when the pipe bending procedure is completed. One advantage of this fourth style of pipe bending shoe is that the flexible web appears to maintain contact with the pipe during the entire pipe bending procedure. Another advantage of this fourth style of pipe bending shoe is that the flexible web provides a flexible engagement surface for the pipe which may reduce the risk of damage to a coating which has been applied to the pipe. A disadvantage of this fourth style of pipe bending shoe is that the force which is applied to the pipe by the pipe bending shoe during the pipe bending procedure may not be evenly distributed along the entire length of the flexible web.

A fifth exemplary style of pipe bending shoe is described in U.S. Pat. No. 7,047,789 (Theener). This pipe bending shoe includes a pin up plate, a first framework pivotally attached to the pin up plate, a second framework pivotally attached to the pin up plate, and a plurality of discrete belts having a first end attached to the first framework and having a second end attached to the second framework, wherein the belts are disposed to an outer surface of a pipe wall in a region which becomes a minor radius of a bend in the pipe. The plurality of belts provide a transversely segmented pipe sling which maintains a straight longitudinal profile during bending of a pipe. An advantage of this fifth style of pipe bending shoe is that the plurality of belts provide a flexible engagement surface for the pipe, which may reduce the risk of damage to a coating which has been applied to the pipe. A disadvantage of this fifth style of pipe bending shoe is that the force which is applied to the pipe by the pipe bending shoe during the pipe bending procedure may not be evenly distributed amongst the belts, which may increase the risk of collapse of the pipe wall and/or damage to a coating which has been applied to the pipe.

SUMMARY OF THE INVENTION

References in this document to dimensions, to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

The present invention is directed at a pipe bending shoe which provides an increasing contact area between the pipe bending shoe and a pipe as a pipe bending procedure progresses and which also provides a flexible engagement surface between the pipe bending shoe and the pipe. The present invention also provides a plurality of discrete segments for applying a force to a pipe during a pipe bending procedure.

In some embodiments, the invention is a pipe bending shoe comprising:

(a) a support frame;

(b) a first bending frame connected with the support frame;

(c) a second bending frame connected with the support frame, wherein the first bending frame and the second bending frame define a pipe channel extending between the first bending frame and the second bending frame; and (d) a plurality of flexible straps spaced along the pipe channel, each of the flexible straps spanning the pipe channel transversely between the first bending frame and the second bending frame, wherein the plurality of flexible straps provide a transversely segmented pipe sling, wherein the pipe sling maintains a constant longitudinal sling profile during bending of a pipe using the pipe bending shoe, and wherein the longitudinal sling profile is convex.

The plurality of flexible straps may be comprised of any number of flexible straps. In some embodiments, the number of flexible straps may be an odd number to provide a well defined "apex" for the convex longitudinal sling profile. In some particular embodiments, the number of flexible straps may be about nine.

The flexible straps may be constructed of any flexible material or combination of materials which provide a suitable strength for use in a pipe bending shoe and a relatively high resistance to stretching (i.e., a relatively high modulus of elasticity). In some embodiments, the flexible straps may be constructed from woven fibers. In some embodiments, the woven fibers may be nylon fibers.

A purpose of the support frame is to provide a rigid support for the first bending frame and the second bending frame. The support frame may be comprised of any structure, device or apparatus and may be constructed of any material or combination of materials which facilitate this purpose. In some embodiments the support frame may be constructed of steel. In some embodiments the support frame may be constructed of a plurality of steel components which may be fastened together by welding.

In some embodiments, another purpose of the support frame is to provide a mount for mounting the pipe bending shoe on a pipe bending apparatus. As a result, in some embodiments, the support frame may be comprised of a mount for mounting the pipe bending shoe on a pipe bending apparatus. The mount may be comprised of any structure, device or apparatus which facilitates mounting the pipe bending shoe on a pipe bending apparatus. In some embodiments, it is desirable for the pipe bending shoe to be able to pivot relative to the pipe bending apparatus. As a result, in some embodiments the mount may be comprised of a pivot mount for pivotally mounting the pipe bending shoe on a pipe bending apparatus. In some embodiments the pivot mount may be comprised of a cylindrical sleeve which may function as a bushing when combined with a mounting pin which may be associated with either the pipe bending shoe or with the pipe bending apparatus.

A purpose of the first bending frame and the second bending frame is to provide a rigid support for the flexible straps so that the pipe sling can maintain a constant longitudinal sling profile during bending of a pipe using the pipe bending shoe. The first bending frame and the second bending frame may be comprised of any structure, device or apparatus and may be constructed of any material or combination of materials which facilitate this purpose. In some embodiments the bending frames may be constructed of steel. In some embodiments the bending frames may be constructed of a plurality of steel components which may be fastened together by welding.

In some embodiments, the first bending frame and the second bending frame may be substantially identical in design and construction but configured to be opposed to each other so as to "mirror" each other.

In some embodiments, the first bending frame and the second bending frame may be fixedly connected with the support frame so that the bending frames do not move relative to the support frame. In some embodiments, the support frame and the bending frames may be constructed as a single frame structure. In some embodiments, the bending frames may be fixedly connected with the support frame by bolting, welding and/or otherwise fastening the bending frames to the support frame.

In some embodiments, the first bending frame and the second bending frame may be pivotally connected with the support frame so that the bending frames can pivot relative to the support frame around pivot axes which are substantially parallel with the pipe channel. The pivot axes may be provided by pivot joints between the bending frames and the support frame which enable pivoting of the bending frames relative to the support frame. The pivot joints may be comprised of any structure, device or apparatus which facilitates pivoting.

In some embodiments in which the bending frames are pivotally connected with the support frame, the pipe bending shoe may be further comprised of stops for limiting outward pivoting of the first bending frame and the second bending frame relative to the support frame. In some embodiments, the stops may be comprised of components of the support frame.

In some embodiments, the plurality of flexible straps may be connected with both the first bending frame and the second bending frame. In such embodiments, the plurality of flexible straps may be connected with the bending frames in any manner which provides adequate strength and which facilitates a convex longitudinal sling profile. The plurality of flexible straps may be connected with the bending frames individually or as one or more combined units. The plurality of flexible straps may be connected with the bending frames directly or through an intermediate structure, device or apparatus.

In some embodiments, the first bending frame may be comprised of a longitudinal first frame profile and the second bending frame may be comprised of a longitudinal second frame profile. In some embodiments the plurality of flexible straps may be connected with the first bending frame and the second bending frame so that they pass over the longitudinal first frame profile and the longitudinal second frame profile.

In some embodiments, the plurality of flexible straps may be connected with the first bending frame along a first frame connection line and the plurality of flexible straps may be connected with the second bending frame along a second frame connection line.

In some embodiments, the pipe bending shoe may be further comprised of a first strap retainer rod. The plurality of flexible straps may be connected with the first strap retainer rod and the first strap retainer rod may be connected with the first bending frame. The first strap retainer rod may define the first frame connection line.

In some embodiments, the first strap retainer rod may be a resilient rod which may be flexed to provide a desired shape of the first frame connection line. In such embodiments, the first strap retainer rod may be constructed of any material or combination of materials which is capable of providing suitable flexibility and strength. In some embodiments, the first strap retainer rod may be comprised of a steel rod.

The plurality of flexible straps may be connected with the first strap retainer rod in any manner. In some embodiments, the plurality of flexible straps may be provided with retainer loops so that the first strap retainer rod may be connected with the plurality of flexible straps by passing through the retainer loops.

The first strap retainer rod may be connected with the first bending frame in any manner. In some embodiments, the first bending frame may be comprised of a plurality of first strap retainer lugs for connecting the first strap retainer rod with the first bending frame. The first strap retainer lugs may be configured in a desired shape for the first frame connection line so that the first strap retainer rod will define the first frame connection line when it is engaged with the first strap retainer lugs.

In some embodiments, the first bending frame may be further comprised of a retainer rod retaining mechanism for maintaining engagement of the first strap retainer rod with the first strap retainer lugs. The retainer rod retaining mechanism may be comprised of any suitable structure, device or apparatus. In some embodiments, the retainer rod retaining mechanism may be comprised of a holddown mechanism. In some embodiments, the holddown mechanism may be comprised of one or more holddown bolts which are threaded into a holddown plate and which urge the first strap retainer rod into engagement with the first strap retainer lugs.

In some embodiments, the pipe bending shoe may be further comprised of a second strap retainer rod. The plurality of flexible straps may be connected with the second strap retainer rod and the second strap retainer rod may be connected with the second bending frame. The second strap retainer rod may define the second frame connection line.

In some embodiments, the second strap retainer rod may be a resilient rod which may be flexed to provide a desired shape of the second frame connection line. In such embodiments, the second strap retainer rod may be constructed of any material or combination of materials which is capable of providing suitable flexibility and strength. In some embodiments, the second strap retainer rod may be comprised of a steel rod.

The plurality of flexible straps may be connected with the second strap retainer rod in any manner. In some embodiments, the plurality of flexible straps may be provided with retainer loops so that the second strap retainer rod may be connected with the plurality of flexible straps by passing through the retainer loops.

The second strap retainer rod may be connected with the second bending frame in any manner. In some embodiments, the second bending frame may be comprised of a plurality of second strap retainer lugs for connecting the second strap retainer rod with the second bending frame. The second strap retainer lugs may be configured in a desired shape for the second frame connection line so that the second strap retainer rod will define the second frame connection line when it is engaged with the second strap retainer lugs.

In some embodiments, the second bending frame may be further comprised of a retainer rod retaining mechanism for maintaining engagement of the second strap retainer rod with the second strap retainer lugs. The retainer rod retaining mechanism may be comprised of any suitable structure, device or apparatus. In some embodiments, the retainer rod retaining mechanism may be comprised of a holddown mechanism. In some embodiments, the holddown mechanism may be comprised of one or more holddown bolts which are threaded into a holddown plate and which urge the second strap retainer rod into engagement with the second strap retainer lugs.

The longitudinal sling profile is the longitudinal "shape" of the pipe sling which is presented to and which engages a pipe during a pipe bending procedure. In some embodiments in which the pipe bending shoe is substantially symmetrical, the longitudinal sling profile is the longitudinal shape of the pipe sling at substantially the center or midpoint of the lengths of the flexible straps.

The longitudinal sling profile is convex such that the transversely segmented pipe sling is curved or rounded outward toward a pipe when the pipe is positioned in the pipe channel. The convex longitudinal sling profile may be achieved in any manner.

In some embodiments, the longitudinal sling profile may be dependent upon the lengths of each of the plurality of flexible straps, upon the shapes of the first frame connection line and the second frame connection line, and upon the shapes of the longitudinal first frame profile and the longitudinal second frame profile.

In some embodiments, the frame connection lines may be straight and the longitudinal frame profiles may be straight. In such embodiments, the convex longitudinal sling profile may be achieved by varying the lengths of the plurality of flexible straps so that the shortest strap or straps are located at the center of the longitudinal sling profile and so that the straps become progressively longer toward the ends of the longitudinal sling profile.

In some embodiments, the lengths of all of the plurality of flexible straps may be substantially equal so that the flexible straps are interchangeable.

In embodiments in which the lengths of all of the plurality of flexible straps are substantially equal, the convex longitudinal sling profile may be achieved by providing a convex longitudinal first frame profile and a convex longitudinal second frame profile. In such embodiments, the first frame connection line and the second frame connection line may be straight, may be convex, or may be concave.

In embodiments in which the frame profiles and the frame connection lines are both convex, the frame connection lines should be less convex than the frame profiles to ensure that the longitudinal sling profile is convex.

In embodiments in which the lengths of all of the plurality of flexible straps are substantially equal and in which the frame profiles are straight, the convex longitudinal sling profile may be achieved by providing a concave first frame connection line and a concave second frame connection line.

In some embodiments, the pipe bending shoe may be further comprised of a strap support system for supporting the flexible straps between the first bending frame and the second bending frame in order to prevent sagging of the flexible straps in the pipe channel. In some embodiments, the strap support system may support the flexible straps at substantially the center or midpoint of the lengths of the flexible straps. The strap support system may support the plurality of flexible straps individually or as one or more units.

The strap support system may be comprised of any structure, device or apparatus which is capable of supporting the plurality of flexible straps without significantly interfering with the convex longitudinal sling profile. In some embodiments, the strap support system may connect the flexible straps with the support frame.

In some embodiments, the strap support system may be comprised of strap hangers which are associated with the plurality of flexible straps and which provide an attachment point on the flexible straps. In some embodiments, the strap hangers may be comprised of support loops which are formed in or connected with the plurality of flexible straps.

In some embodiments, the plurality of flexible straps may each be supported individually by the strap hangers. In some embodiments, the strap hangers may be directly connected with the support frame. In some embodiments, the strap hangers may be connected with an intermediate structure, device or apparatus which in turn may be connected with the support frame in order to support the plurality of flexible straps.

In some embodiments, the strap support system may be further comprised of a strap support rod as an intermediate structure, for interconnecting each of the plurality of flexible straps by connecting with the strap hangers. The strap support rod may be constructed of any suitable material or combination of materials. In some embodiments, the strap support rod may be comprised of a resilient steel rod.

In some embodiments in which the strap hangers are comprised of support loops, the strap support rod may interconnect each of the plurality of flexible straps by passing through the support loops.

In some embodiments in which the strap support system is comprised of an intermediate structure such as a strap support rod, the strap support system may be further comprised of a strap support connector for connecting the intermediate structure with the support frame. In some embodiments, the strap support connector may be comprised of one or more elastic cords. In some embodiments, the strap support connector may be comprised of a pair of elastic cords.

BRIEF DESCRIPTION OF DRAWINGS

Embodiments of the invention will now be described with reference to the accompanying drawings, in which.

DETAILED DESCRIPTION

Referring to FIGS. 1-5, the present invention is a pipe bending shoe having a plurality of flexible straps which provide a transversely segmented pipe sling. The pipe sling maintains a constant convex longitudinal sling profile during bending of a pipe, thereby providing an increasing contact area between the pipe bending shoe and a pipe during a pipe bending procedure.

In the context of the invention and this document, the convex longitudinal sling profile is "constant" to the extent of the limits of the properties of the materials comprising the pipe bending shoe. In other words, although the invention is directed at providing a constant longitudinal sling profile, it is recognized that the application of forces to the pipe bending shoe during a pipe bending procedure will inevitably result in some elastic deformation of the materials comprising the pipe bending shoe. As a result, the term "constant longitudinal sling profile" does not exclude minor variations in the longitudinal sling profile which may result from the inevitable elastic deformation of the materials comprising the pipe bending shoe.

Figure 1:
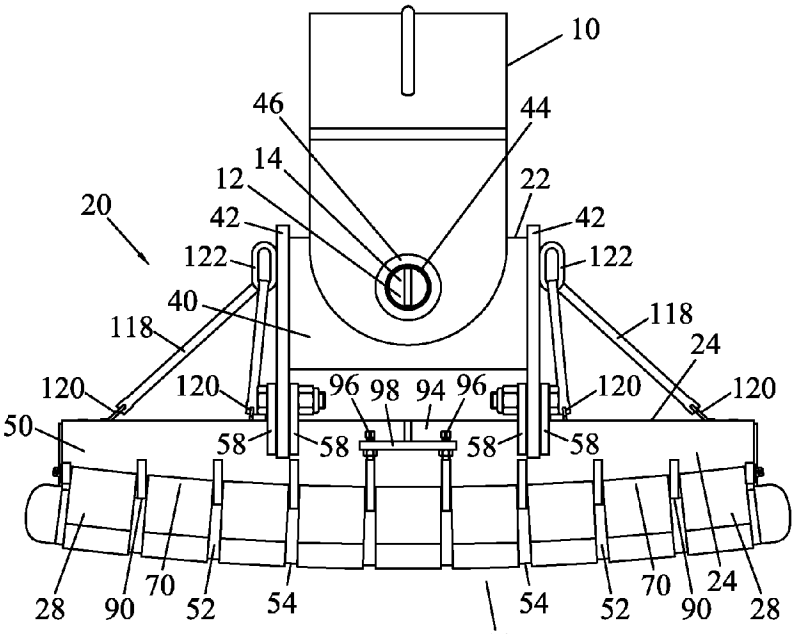
FIG. 1 is a side view of a first embodiment of a pipe bending shoe according to the invention, as mounted on a tractor bracket.
Figure 2:
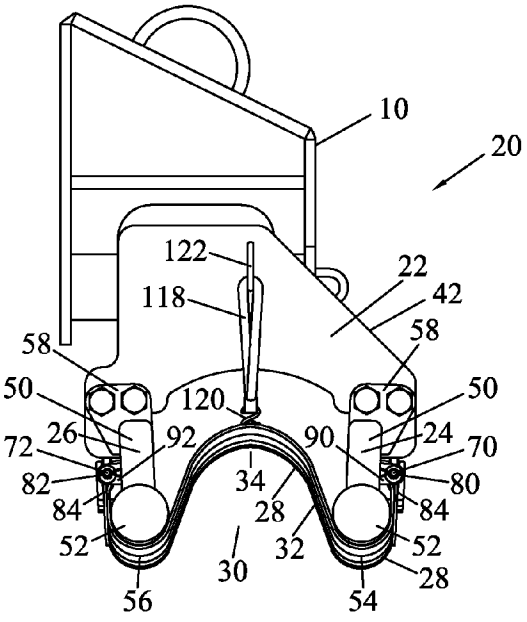
FIG. 2 is an end view of the pipe bending shoe depicted in FIG. 1.
Figure 3:
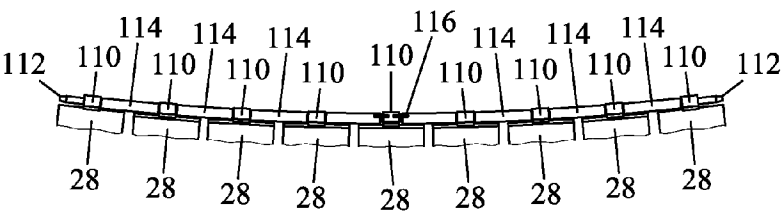
FIG. 3 is an isolated partial cutaway side view of a strap support rod for the pipe bending shoe depicted in FIG. 1.

Referring to FIGS. 1-3, a first embodiment of the pipe bending shoe (20) is depicted.

As depicted in FIGS. 1-3, the pipe bending shoe (20) is mounted on a tractor bracket (10) which is a component of a tractor (not shown). The pipe bending shoe (20) enables the tractor to function as a pipe bending apparatus.

The pipe bending shoe (20) is comprised of a support frame (22), a first bending frame (24), a second bending frame (26), and a plurality of flexible straps (28).

The first bending frame (24) and the second bending frame (26) define a pipe channel (30) extending between the bending frames (24,26). The plurality of flexible straps (28) span the pipe channel (30) transversely between the bending frames (24,26) so that the plurality of flexible straps (28) provide a transversely segmented pipe sling (32) having a longitudinal sling profile (34) which is convex.

As depicted in FIGS. 1-3, the plurality of flexible straps (28) consists of nine relatively narrow flexible straps (28). The number, length and width of the flexible straps (28) may be varied within the scope of the invention.

The support frame (22) is comprised of a support frame body (40) and a pair of end plates (42). The support frame body (40) is comprised of a length of a hollow square section structural steel member. The end plates (42) are constructed of steel and are welded to the ends of the support frame body (40).

The support frame (22) is provided with a pivot mount (44) for mounting the pipe bending shoe (20) on the tractor bracket (10). The pivot mount (44) is comprised of a cylindrical steel sleeve (46) which is welded to apertures which are cut in the support frame body (40). The cylindrical sleeve provides a bushing for the pivot mount (44).

The pipe bending shoe (20) is pivotally mounted on the tractor bracket (10) using the pivot mount (44) so that the pipe bending shoe (20) can pivot relative to the tractor bracket (10). The pipe bending shoe (20) is mounted on the tractor bracket (10) by lining up the cylindrical sleeve (46) with mounting eyes (12) on the tractor bracket (10) and passing a mounting pin (14) through the mounting eyes (12) and the cylindrical sleeve (46) in order to pivotally connect the pipe bending shoe (20) with the tractor bracket (10).

The first bending frame (24) and the second bending frame (26) are connected with the support frame (22). In the embodiment of FIGS. 1-3, the bending frames (24,26) are both fixedly connected with the support frame (22) so that the bending frames (24,26) do not move relative to the support frame (22).

Referring to FIG. 1 and FIG. 2, each of the bending frames (24,26) is essentially identical in design and construction, but the bending frames (24,26) are configured to be opposed to each other so as to "mirror" each other. As a result, the description of the bending frames (24,26) which follows applies equally to both the first bending frame (24) and the second bending frame (26).

Referring to FIG. 1 and FIG. 2, each of the bending frames (24,26) is comprised of a bending frame tube (50) and a bending frame pipe (52). The bending frame tube (50) is comprised of a hollow rectangular structural steel member. The bending frame pipe (52) is comprised of a cylindrical structural steel tube. The bending frame pipe (52) is welded to the lower end of the bending frame tube (50).

The bending frame pipe (52) of the first bending frame (24) provides a longitudinal first frame profile (54). The bending frame pipe (52) of the second bending frame (26) provides a longitudinal second frame profile (56). As depicted in FIG. 2, the longitudinal frame profiles (54,56) are convex.

The longitudinal frame profiles (54,56) are provided by bending the bending frame pipe (52) to the desired convex shape and by cutting the lower end of the bending frame tube (50) to match the bending frame pipe (52) in order to facilitate welding of the bending frame pipe (52) to the bending frame tube (50).

Referring again to FIG. 1 and FIG. 2, each of the bending frames (24,26) is further comprised of four mounting plates (58) which are welded to the upper end of the bending frame tube (50).

In each of the bending frames (24,26), the mounting plates (58) are spaced along the bending frame tube (50) so that two mounting plates (58) straddle each of the two end plates (42) of the support frame (22).

The bending frames (24,26) may be fixedly connected with the support frame by welding the mounting plates (58) of the bending frames (24,26) to the end plates (42) of the support frame (22). As an alternative to welding or in addition to welding, and as depicted in FIG. 1 and FIG. 2, two or more holes may be provided in each of the mounting plates (58) and corresponding holes may be provided in the end plates (42) to facilitate the use of fasteners (60) such as bolts and nuts to fixedly connect the bending frames (24,26) with the support frame (22).

In the embodiment of FIGS. 1-3, the plurality of flexible straps (28) are connected with both the first bending frame (24) and the second bending frame (26) so that they pass over the longitudinal frame profiles (54,56). The plurality of flexible straps (28) are connected with the first bending frame (24) along a first frame connection line (70). The plurality of flexible straps (28) are connected with the second bending frame (26) along a second frame connection line (72).

In the embodiment of FIGS. 1-3, the lengths of all of the plurality of flexible straps (28) are substantially equal. As a result, the convex longitudinal sling profile (34) is provided by the longitudinal frame profiles (54,56) and by the frame connection lines (70,72). As depicted in FIG. 1, the first longitudinal frame profile (54) and the first frame connection line (70) are both convex and have a comparable curve or radius.

In the embodiment of FIGS. 1-3, the pipe bending shoe (20) is further comprised of a first strap retainer rod (80) and a second strap retainer rod (82). The retainer rods (80,82) are comprised of steel rods.

The plurality of flexible straps (28) are connected with the first strap retainer rod (80) and the first strap retainer rod (80) is connected with the first bending frame (24) in order to connect the plurality of flexible straps (28) with the first bending frame (24). Similarly, the plurality of flexible straps (28) are connected with the second strap retainer rod (82) and the second strap retainer rod (80) is connected with the second bending frame (24) in order to connect the plurality of flexible straps (28) with the second bending frame (24).

In the embodiment of FIGS. 1-3, the plurality of flexible straps (28) are each provided with retainer loops (84) adjacent to both ends of the flexible straps (28) and the retainer rods (80,82) are passed through the retainer loops (84) in order to connect the flexible straps (28) with the retainer rods (80,82).

In the embodiment of FIGS. 1-3, the first bending frame (24) is further comprised of a plurality of first strap retainer lugs (90) for connecting the first strap retainer rod (80) with the first bending frame (24). The first strap retainer lugs (90) are configured on the first bending frame (24) to provide the convex shape of the first frame connection line (70) so that the first strap retainer rod (80) defines the first frame connection line (70) when it is engaged with the first strap retainer lugs (90).

Similarly, the second bending frame (26) is further comprised of a plurality of second strap retainer lugs (92) for connecting the second strap retainer rod (82) with the second bending frame (26). The second strap retainer lugs (92) are configured on the second bending frame (26) to provide the convex shape of the second frame connection line (72) so that the second strap retainer rod (82) defines the second frame connection line (72) when it is engaged with the first strap retainer lugs (92).

In the embodiment of FIGS. 1-3, the retainer lugs (90,92) are open at their upper ends. This configuration enables the flexible straps (28) to be connected with the retainer rods (80,82) before the retainer rods (80,82) are engaged with the retainer lugs (90,92). Consequently, each of the bending frames (24,26) is further comprised of a retainer rod retaining mechanism (94) for maintaining engagement between the retainer rods (80,82) and the retainer lugs (90,92). As depicted in FIG. 1, each retainer rod retaining mechanism is comprised of a holddown mechanism, which in turn is comprised of a pair of holddown bolts (96) which are threaded into a holddown plate (98) and which can be advanced to urge the retainer rods (80,82) into engagement with the retainer lugs (90,92).

In the embodiment of FIGS. 1-3, the pipe bending shoe (20) is further comprised of a strap support system for supporting the flexible straps (28) between the first bending frame (24) and the second bending frame (26) in order to prevent sagging of the flexible straps (28) in the pipe channel (30).

Referring to FIG. 3, the strap support system is comprised of strap hangers which are associated with each of the plurality of flexible straps (28). As depicted in FIG. 3, the strap hangers are comprised of support loops (110) which are formed in or connected with the plurality of flexible straps (28) substantially at the center or midpoint of the lengths of the flexible straps (28).

The strap support system is further comprised of a strap support rod (112), which interconnects each of the flexible straps (28) by passing through the support loops (110). In the embodiment of FIGS. 1-3, the strap support rod (112) is comprised of a resilient steel rod which is straight, but which may easily be flexed to accommodate the longitudinal sling profile.

Spacers (114) are provided on the strap support rod (112) between the support loops (110) to limit movement of the support loops (110) along the strap support rod (112). In the embodiment of FIGS. 1-3, the spacers (114) are comprised of lengths of hose, such as fuel line hose, which are sized to fit over the strap support rod (112).

Referring to FIG. 3, the support loop (110) which is associated with the middle flexible strap (28) is releasably fastened to the strap support rod (112) with a fastener (116) in order to maintain the position of the flexible straps (28) on the strap support rod (112). In the embodiment of FIGS. 1-3, the fastener (116) is comprised of a linch pin.

The strap support rod (112) is connected with the support frame (22) so that the flexible straps (28) are connected with and supported by the support frame (22). The strap support rod (112) is connected with the support frame (22) with a strap support connector.

In the embodiment of FIGS. 1-3, the strap support connector is comprised of a pair of elastic cords (118) such as bungee cords, with hooks (120) at both ends. The hooks (120) on both ends of the elastic cords (118) are hooked onto the strap support rod (112) and the elastic cords (118) pass through mounting rings (122) on the support frame (22) in order to connect the strap support rod (112) with the support frame (22).

Referring to FIG. 2, the strap support system lifts the flexible straps (28) in the pipe channel (30), thereby preventing sagging of the flexible straps (28).

Figure 4:
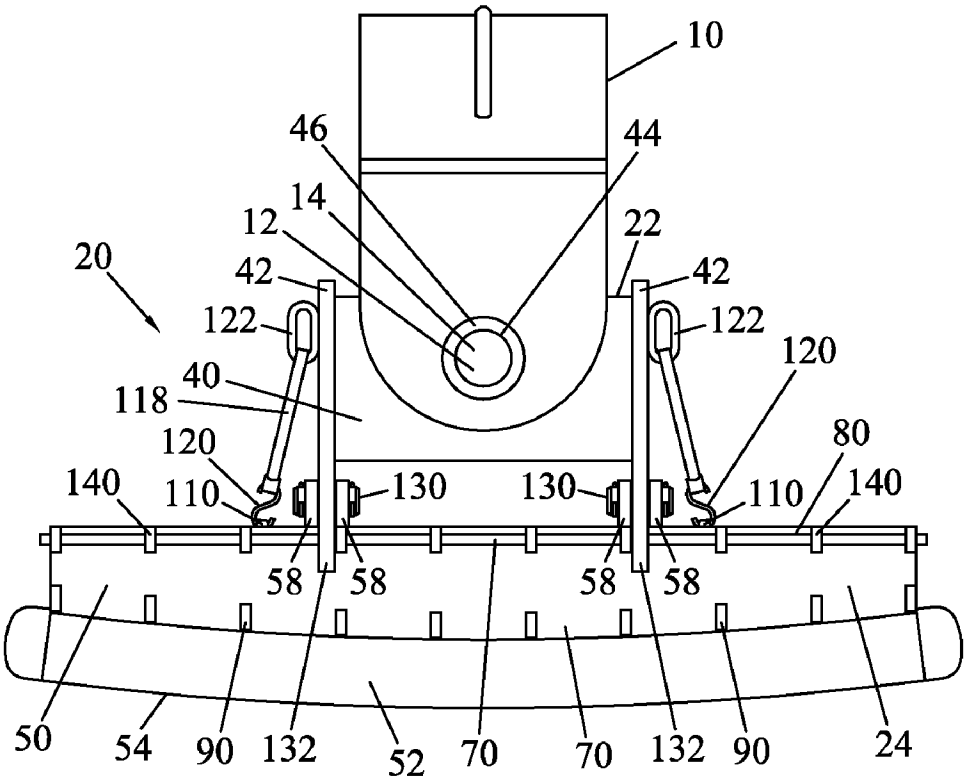
FIG. 4 is a side view of a second embodiment of a pipe bending shoe according to the invention, as mounted on a tractor bracket.
Figure 5:
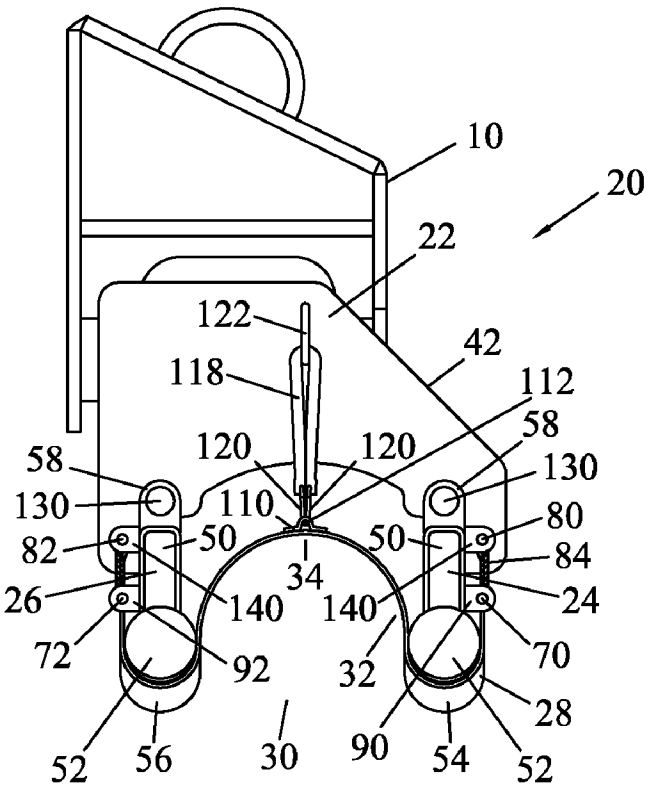
FIG. 5 is an end view of the pipe bending shoe depicted in FIG. 4.

Referring to FIGS. 4-5, a second embodiment of the pipe bending shoe (20) is depicted. The second embodiment of the pipe bending shoe (20) is similar to the first embodiment depicted in FIGS. 1-3. The plurality of flexible straps (28) are omitted in FIG. 4, in order to more clearly depict details of the first bending frame (24).

In the description of the second embodiment which follows, only those features which are different from the first embodiment will be described. The same reference numbers which were assigned to features of the first embodiment of FIGS. 1-3 will be assigned to the equivalent features of the second embodiment of FIGS. 4-5, and the above description of the first embodiment of FIGS. 1-3 shall apply to those features and reference numbers which are common to both the first embodiment and the second embodiment.

In the embodiment of FIGS. 4-5, the first bending frame (24) and the second bending frame (26) are pivotally connected with the support frame (22) so that the bending frames (24,26) can pivot relative to the support frame (22) about pivot axes which are substantially parallel with the pipe channel (30).

In the embodiment of FIGS. 4-5, each of the two pivot axes is provided by two clevis pins (130) which pass through holes in the mounting plates (58) of the bending frames (24,26) and corresponding holes in the end plates (42) of the support frame (22).

The pivotal connection between the bending frames (24, 26) and the support frame (22) enables the bending frames (24,26) to pivot inward toward each other and outward away from each other. For example, during a pipe bending procedure, the reaction force applied to the plurality of flexible straps (28) by the pipe will tend to cause the bending frames (24,26) to pivot inward toward each other and thereby encircle the pipe, which may provide additional support to the pipe to prevent collapse of the pipe.

In the embodiment of FIGS. 4-5, the pipe bending shoe (20) is further comprised of stops (132) for limiting the pivoting of the bending frames (24,26) outward away from each other. As depicted in FIGS. 4-5, the stops (132) are comprised of extensions of the end plates (42) of the support frame (22) which extend downward and which will engage the bending frames (24,26) as they pivot outward away from each other. The stops (132) further inhibit sagging of the flexible straps (28) in the pipe channel (30) by limiting the distance which the flexible straps (28) must span between the first bending frame (24) and the second bending frame (26).

In the embodiment of FIGS. 4-5, the retainer lugs (90,92) are substantially circular apertures so that they are not open at their upper ends. This configuration requires that the flexible straps (28) be connected with the retainer rods (80,82) individually as the retainer rods (80,82) are passed through the apertures in the retainer lugs (90,92). As a result, the retainer rod retaining mechanism (94) of the embodiment of FIGS. 1-3 is not required in order to maintain engagement between the retainer rods (80,82) and the retainer lugs (90,92), and is therefore omitted.

In the embodiment of FIGS. 4-5, each of the bending frames (24,26) is comprised of a second set of retainer lugs (140) in addition to the retainer lugs (90,92). The second set of retainer lugs (140) is located above the retainer lugs (90, 92).

The retainer lugs (90,92) may be used when the pipe bending shoe (20) is used for bending relatively large diameter pipe, and the second set of retainer lugs (140) may be used when the pipe bending shoe (20) is used for bending relatively small diameter pipe. As depicted in FIG. 4, the second set of retainer lugs (140) is configured to provide straight frame connection lines (70,72) so that the convex longitudinal sling profile is provided by the convex longitudinal frame profiles (54,56).

To prepare the pipe bending shoe (20) for use, the plurality of flexible straps (28) is first connected with the strap support rod (112) by passing the strap support rod (112) sequentially through the support loops (110) and alternating each support loop (110) with a spacer (114). The fastener (116) may then be used to connect the support loop (110) of the middle flexible strap (28) with the strap support rod (112).

The plurality of flexible straps (28) may then be connected with the retainer rods (80,82) and the support frames (24,26).

In the embodiment of FIGS. 1-3, the retainer rods (80,82) may be passed through all of the retainer loops (84). The retainer rods (80,82) may then be positioned adjacent to the retainer lugs (90,92) and the retainer rod retaining mechanism (94) may be used to urge the retainer rods (80,82) into engagement with the retainer lugs (90,92).

In the embodiment of FIGS. 4-5, the retainer rods (80,82) must be passed sequentially through the retainer loops (84) as the retainer rods (80,82) are advanced through the apertures in the retainer lugs (90,92) or the apertures in the second sets of retainer lugs (140). As depicted in FIG. 5, the retainer rods (80,82) are advanced through the apertures in the second sets of retainer lugs (140).

To complete the assembly of the pipe bending shoe (20), one end of each of the elastic cords (118) is connected with the strap support rod (112), each of the elastic cords (118) is passed through one of the mounting rings (122), and the other end of each of the elastic cords (118) is then connected with the strap support rod (112).

Once the pipe bending shoe (20) has been assembled for use, the pipe bending shoe (20) may be mounted on a tractor (not shown) or other pipe bending apparatus (not shown). In the embodiments of FIGS. 1-3 and 4-5, the pipe bending shoe (20) may be mounted on a tractor by pivotally mounting the pipe bending shoe on a tractor bracket (10) which is located on the tractor using the pivot mount (44) on the pipe bending shoe (20).

The pipe bending shoe (20) may be pivotally mounted on the tractor bracket (10) by lining up the cylindrical sleeve (46) with mounting eyes (12) on the tractor bracket (10) and then passing a mounting pin (14) through the mounting eyes (12) and the cylindrical sleeve (46). The mounting pin (14) may be retained in position using a cotter pin.

Once the pipe bending shoe (20) is mounted on the tractor or other pipe bending apparatus, a pipe bending procedure may be performed. If the pipe bending shoe (20) is mounted on a tractor, the pipe bending procedure may be performed by selecting a length of pipe, moving the pipe or the tractor so that the pipe is adjacent to the tractor and the pipe bending shoe (20), attaching a lifting device (not shown) such as a sling to a first end of the pipe, and then lifting the first end of the pipe until it engages one or more of the flexible straps (28) of the pipe bending shoe (20).

The pipe will then be contacted at the first end of the pipe by the lifting device, will be contacted at a second end of the pipe by a ground surface (not shown), and will be contacted between the first and second ends of the pipe by the pipe bending shoe (20).

The lifting device can then be used to further lift the first end of the pipe, which will cause the pipe to bend around the pipe bending shoe (20). As the pipe bends around the pipe bending shoe (20), the pipe bending shoe (20) will pivot relative to the tractor bracket (10), the pipe will progressively conform to the longitudinal sling profile (34), and the pipe bending shoe (20) will progressively use a larger number of the flexible straps (28) to apply the bending force to the pipe so that the contact area between the pipe bending shoe (20) and the pipe progressively increases.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A pipe bending shoe comprising:

(a) a support frame;

(b) a first bending frame connected with the support frame;

(c) a second bending frame connected with the support frame, wherein the first bending frame and the second bending frame define a pipe channel extending between the first bending frame and the second bending frame; and (d) a plurality of flexible straps spaced along the pipe channel, each of the flexible straps spanning the pipe channel transversely between the first bending frame and the second bending frame, wherein the plurality of flexible straps provide a transversely segmented pipe sling, wherein the pipe sling maintains a constant longitudinal sling profile during bending of a pipe using the pipe bending shoe, and wherein the longitudinal sling profile is convex.

2. The pipe bending shoe as claimed in claim 1 wherein the first bending frame and the second bending frame are fixedly connected with the support frame.

3. The pipe bending shoe as claimed in claim 1 wherein the first bending frame and the second bending frame are pivotally connected with the support frame.

4. The pipe bending shoe as claimed in claim 3 wherein the support frame is comprised of stops for limiting outward pivoting of the first bending frame and the second bending frame relative to the support frame.

5. The pipe bending shoe as claimed in claim 1 wherein each of the plurality of flexible straps has a length, and wherein the lengths of all of the plurality of flexible straps are equal so that the flexible straps are interchangeable.

6. The pipe bending shoe as claimed in claim 1 wherein the plurality of flexible straps are connected with both the first bending frame and the second bending frame.

7. The pipe bending shoe as claimed in claim 6 wherein each of the plurality of flexible straps has a length, and wherein the lengths of all of the plurality of flexible straps are equal so that the flexible straps are interchangeable.

8. The pipe bending shoe as claimed in claim 7 wherein the first bending frame is comprised of a longitudinal first frame profile, wherein the second bending frame is comprised of a longitudinal second frame profile, wherein the longitudinal first frame profile and the longitudinal second frame profile are both convex, and wherein the plurality of flexible straps are connected with the first bending frame and the second bending frame so that they pass over the longitudinal first frame profile and the longitudinal second frame profile.

9. The pipe bending shoe as claimed in claim 8 wherein the plurality of flexible straps are connected with the first bending frame along a first frame connection line and wherein the plurality of flexible straps are connected with the second bending frame along a second frame connection line.

10. The pipe bending shoe as claimed in claim 9, further comprising:

(e) a first strap retainer rod, wherein the plurality of flexible straps are connected with the first strap retainer rod and the first strap retainer rod is connected with the first bending frame in order to connect the plurality of flexible straps with the first bending frame, and wherein the first frame connection line is defined by the first strap retainer rod; and (f) a second strap retainer rod, wherein the plurality of flexible straps are connected with the second strap retainer rod and the second strap retainer rod is connected with the second bending frame in order to connect the plurality of flexible straps with the second bending frame, and wherein the second frame connection line is defined by the second strap retainer rod.

11. The pipe bending shoe as claimed in claim 9 wherein the first frame connection line and the second frame connection line is straight.

12. The pipe bending shoe as claimed in claim 9 wherein the first frame connection line and the second frame connection line are convex.

13. The pipe bending shoe as claimed in claim 1, further comprising a strap support system for supporting the flexible straps between the first bending frame and the second bending frame.

14. The pipe bending shoe as claimed in claim 13 wherein the strap support system is comprised of strap hangers which are associated with the plurality of flexible straps.

15. The pipe bending shoe as claimed in claim 14 wherein the strap support system is further comprised of a strap support rod for interconnecting each of the plurality of flexible straps by connecting with the strap hangers.

16. The pipe bending shoe as claimed in claim 15 wherein the strap support system is further comprised of a strap support connector for connecting the strap support rod with the support frame.

17. The pipe bending shoe as claimed in claim 16 wherein the strap support connector is comprised of a pair of elastic cords.

18. The pipe bending shoe as claimed in claim 1 wherein the support frame is comprised of a mount for mounting the pipe bending shoe on a pipe bending apparatus.

19. The pipe bending shoe as claimed in claim 18 wherein the mount is a pivot mount for pivotally mounting the pipe bending shoe on the pipe bending apparatus.

* * * * *